US005814925A

United States Patent [19]

Tomihari

[11] Patent Number: 5,814,925

[45] Date of Patent: Sep. 29, 1998

[54] ELECTRON SOURCE WITH MICROTIP EMISSIVE CATHODES

[75] Inventor: Yoshinori Tomihari, Shiga, Japan

[73] Assignee: NEC Corporation, Tokyo, Japan

[21] Appl. No.: 532,985

[22] Filed: Sep. 22, 1995

[30] Foreign Application Priority Data

Sep. 26, 1994 [JP] Japan ..... 6-229415

[51] Int. Cl.[6] ..... H01J 1/30

[52] U.S. Cl. ..... 313/309; 313/495; 313/497; 313/336; 313/351

[58] Field of Search ..... 313/309, 310, 313/336, 351, 495, 496, 497

[56] References Cited

U.S. PATENT DOCUMENTS 5,194,780 3/1993 Meyer ..... 313/309 X 5,534,744 7/1996 Leroux et al. ..... 313/309

5,536,993 7/1996 Taylor et al. ..... 313/309 X 5,578,896 11/1996 Huang ..... 313/309

*Primary Examiner*—Ashok Patel

*Attorney, Agent, or Firm*—Young & Thompson

[57] ABSTRACT

An emissive electron source includes a first electrode (12) formed on an insulating substrate (1) in a form of mesh and a resistive coating (13) formed on the entire surface thereof. A plurality of cathodes (14) are disposed at the center of the mesh pattern to have the equal minimum distance between the respective cathodes (14) and the first electrode (12), and thereby improving the capability for limiting short-circuiting current in a resistive coating.

9 Claims, 3 Drawing Sheets

ELECTRON SOURCE WITH MICROTIP EMISSIVE CATHODES

BACKGROUND OF THE INVENTION

1. Field of the Invention

The present invention relates to an emissive electron source of field emission type, and, more particularly, to a microtip emissive electron source of field emission type for a cathode ray tube.

2. Description of the Prior Art

As an electron gun for a flat cathode ray tube, U.S. Pat. No. 5,194,780 discloses an emissive electron source of field emission type in which a number of microtip cathodes are arranged on a plane as shown in FIG. 4. A first electrode 2 is deposited on an insulating substrate 1 of a glass plates. The first electrode 2 of aluminum has a circular opening with a diameter ø of several to several tens of micrometers. A resistive coating 3 of a thin film silicon is deposited on the entire surface of the first electrode 2. The thin film has is several tens of angstroms to several micrometers in thickness and has a resistivity of several hundred to several million ohm-centimeters. A conical cathode 4 is formed on the opening of the first electrode 2 through resistive coating 3. The cathode 4 consists of metal such as tungsten or molybdenum with high melting point and a low work function, and has a sharp tip.

An insulating layer 6 of silicon oxide is formed around the cathode 4. The insulating layer 6 has an opening diameter width W in the range 1 $\mu$m–1.5 $\mu$m. A second electrode 7 or a gate electrode composed of metal with a high melting point such as molybdenum, tungsten or niobium is disposed on the insulating layer 6 as an opposed electrode to the cathode 4.

Such an emissive electron source can emit electrons without heating the cathode 4 by applying a voltage, which provides electric field intensity of about 10 KV/cm or more (several volts for the above device), between the second electrode 7 and the cathode 4. Then, when this emissive electron source is used as the electron gun of a flat cathode ray tube, and arranged at a pitch of, for example, about 20 $\mu$m, a flat display can be obtained, with several thousand millions of picture elements, low operating voltage, and low power consumption.

However, since the distance between the second electrode 7 and the cathode 4 is as little as 0.5 $\mu$m–0.75 $\mu$m, if dirt attaches on the device during operation to short-circuit the second electrode 7 and the cathode 4, the short-circuiting current may destroy the device. Therefore, the above-mentioned emissive electron source is arranged to limit the short-circuiting current with the resistance of the resistive coating 3 so that the device is protected from destruction by the short-circuiting. However, because the resistive coating is thin, its resistance depends on spacing between the first electrode 2 and the cathode 4. Thus, when the pitch between the cathodes is further reduced as in a high definition color display, there arises the problem that the resistance of the resistive coating decreases and its capability for limiting short-circuiting is also deteriorated.

To this end, U.S. Pat. No. 5,194,780 discloses the arrangement of first electrode 2 in the form of a mesh as shown in FIG. 5, and thirty-six cathodes 10, are arranged in a 6×6 matrix in an area surrounded by the first electrode to increase the distance between the first electrode and the cathodes to improve the capability of the resistive coating for limiting short-circuiting current.

However, since the cathodes 10 positioned near the outer Periphery close to the first electrode 8 have resistances different from that of the cathodes 10 positioned at the center and therefore removed from the first electrode 8, there is a difference in the intensity of electric field being applied, leading to uneven electron emission characteristics.

SUMMARY OF THE INVENTION

An object of the present invention is to provide an emissive electron source with even electron emission characteristics and to improve the capability for limiting short-circuiting current in a resistive coating.

According to the present invention, a first electrode is arranged in a form of mesh, and a plurality of cathodes are arranged at the central section of an area surrounded by the first electrode with equal distance from the first electrode.

An emissive electron source according to the present invention comprises a first electrode formed on an insulating substrate in a form of mesh and a resistive coating formed on the entire surface thereof. An insulating layer for forming cavities and a second electrode are sequentially laminated and a plurality of cavities are formed in a mesh divided by the first electrode. Conical cathodes are disposed in the respective cavities in contact with the resistive coating and the respective cathodes are disposed to have the equal minimum distance with respect to the first electrode.

It is desirable that the first electrode is formed in a regular n-sided polygon mesh pattern, and the same numbers (n) of cathodes are disposed at the center of the mesh pattern in a regular n-sided pattern, or that the first electrode is formed in a rectangular mesh pattern, and a plurality of cathodes are disposed at the center of the mesh pattern in a similar shape.

According to the emissive electron source of the present invention, since each cathode is disposed at an equal distance from the first electrode applying voltage to the cathode, the resistive coating provides equal resistance to every cathode so that even electron emission characteristics are attained. In addition, since a plurality of cathodes can be disposed in an area surrounded by the first electrode, the resistance of the resistive coating can be increased even if the pitch between the cathodes is made very small, the capability for limiting the short-circuiting current can be improved even if the cathode density is increased. Furthermore, even electron emission can be maintained by the resistive coating between the cathodes.

BRIEF DESCRIPTION OF THE DRAWINGS

This above-mentioned and other objects, features and advantages of this invention will become more apparent by reference to the following detailed description of the invention taken in conjunction with the accompanying drawings, wherein:

FIG. 1 (*b*) is a plan view illustrating the arrangement of cathodes in the emissive electron source according to the first embodiment of the present invention.

DETAILED DESCRIPTION OF THE PREFERRED EMBODIMENTS

Figure 1A:
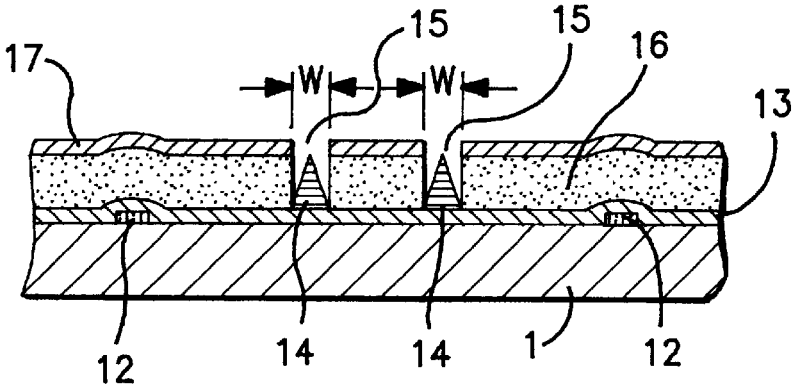
FIG. 1 (*a*) is a sectional view of essential parts of the emissive electron source according to a first embodiment of the present invention.

Now, the present invention is described in detail by referring to the drawings. Similar references are used for like components in the prior art, and description of them is omitted.

Figure 1B:
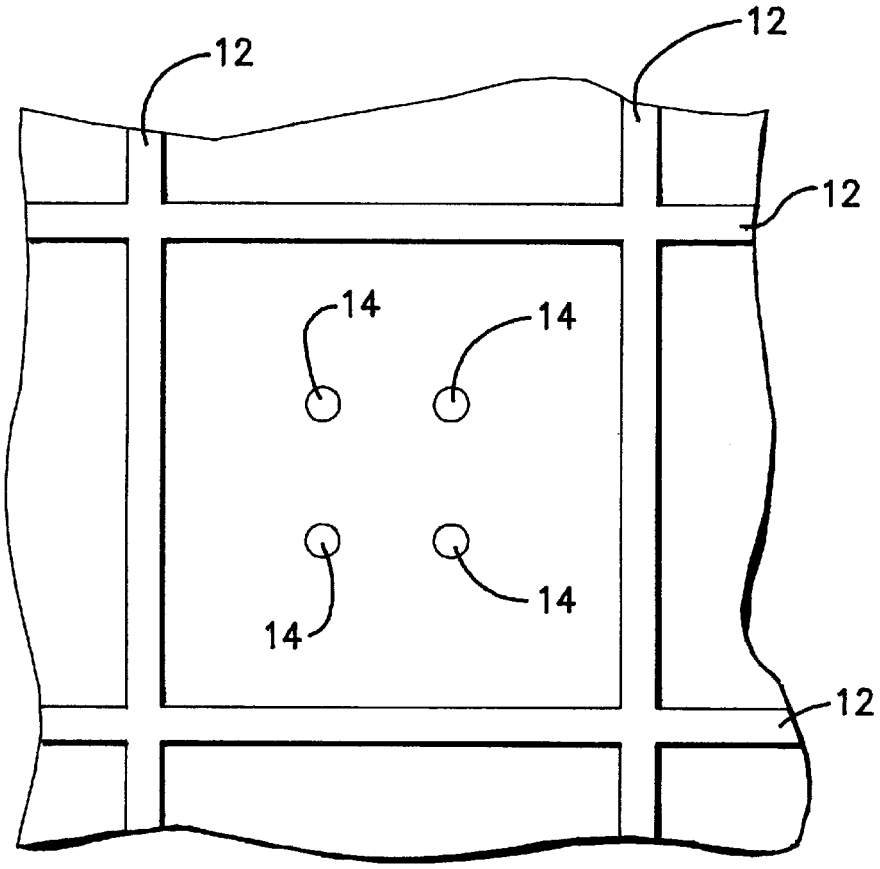

In an emissive electron source according to a first embodiment of the present invention, a first electrode 12 consisting of aluminum or the like and having a width of about 1 μm and a thickness of 0.2 μm as shown in FIG. 1 (*a*) is deposited on an insulating substrate 1 such as glass in a form of mesh with a pitch of 16 μm as shown in FIG. 1 (*b*). A resistive coating 13 consisting of a silicon film or the like which has a thickness of about 0.5 μm and resistance of about 3000 Ω·cm is deposited on the entire surface of the insulating substrate 1 including the first electrode. Four conical cathodes 14 are disposed in a form of square with a pitch of 4 μm at the center of an area surrounded by the first electrode 12 on the resistive coating 13, as shown in FIG. 1 (*b*). The conical cathode 14 consists of metal such as tungsten or molybdenum with a high melting point and a low work function and has a sharp tip with a bottom diameter of about 1 μm.

An insulating layer 16 is formed around the cathode 14. Layer 16 consists of silicon oxide or the like in a thickness of about 2 μm having cavities 15 with an opening width W of a diameter 1 μm–1.5 μm. A second electrode 17 or a gate electrode composed of metal with high melting point such as molybdenum, tungsten or niobium is disposed on the insulating layer 16 as an opposed electrode to the cathode 14.

Such an emissive electron source can emit electrons without heating the cathode 14 by applying a voltage, which provides electric field intensity of about 10 KV/cm or more (several volts for the above device), between the second electrode 17 or the gate electrode and the cathode 14.

In this emissive electron source, since the distance between the second electrode 17 and the cathode 14 is as little as 0.5 μm–0.75 μm, short-circuiting current flow through the resistive layer 13 when dirt or dust attaches during operation. However, the resistance of the resistive layer 13 limits the flow of short-circuiting current, and prevents the device from destruction due to short-circuiting. In addition, because the distance is equal between the first electrode and respective cathodes 14, the voltage applied to the respective cathodes through the resistive coating 13 becomes equal, and the resistive coating 13 regulates the applied voltage to the respective cathodes so that even electron emission can be attained.

Figure 2:
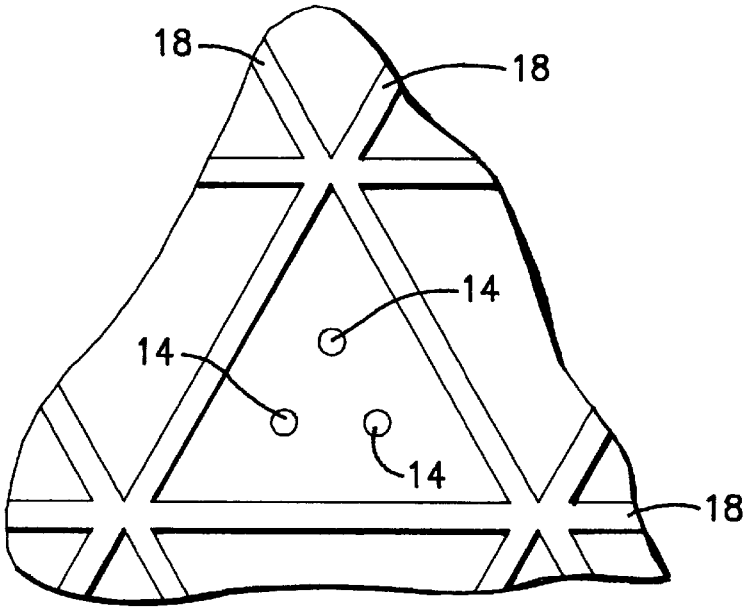
FIG. 2 is a plan view illustrating the arrangement of cathodes in the emissive electron source according to a second embodiment of the present invention.

A second embodiment is, as shown in FIG. 2, an emissive electron source in which a first electrode 18 consisting of aluminum or the like and having a width of about 1 μm and a thickness of 0.2 μm is deposited on an insulating substrate 1 such as glass with a pitch of 19 μm to form an equilateral triangular mesh. A resistive coating 13 consisting of a silicon film or the like which has a thickness of about 0.5 μm and resistance of about 3000 Ω·cm is deposited on the entire surface of the insulating substrate 1 including the first electrode. Three conical cathodes 14 are disposed in a form of equilateral triangle with a pitch of 4 μm at the center of an area surrounded by the first electrode 18 on the resistive coating 13. The conical cathode 14 consists of metal such as tungsten or molybdenum with a high melting point and a low work function and has a sharp tip with a bottom diameter of about 1 μm. Although not shown in the figure, the cavity, insulating layer and second electrode, are formed in the same manner as in the first embodiment.

In the case of this embodiment, although the cathode density is less than that of the first embodiment, the second embodiment is suitable for an electron gun for a color display with three guns. It has the same advantages as the first embodiment in that it can prevent destruction of the device due to short-circuiting between the second electrode and the cathode, and electrons are evenly emitted from the cathode.

Figure 3:
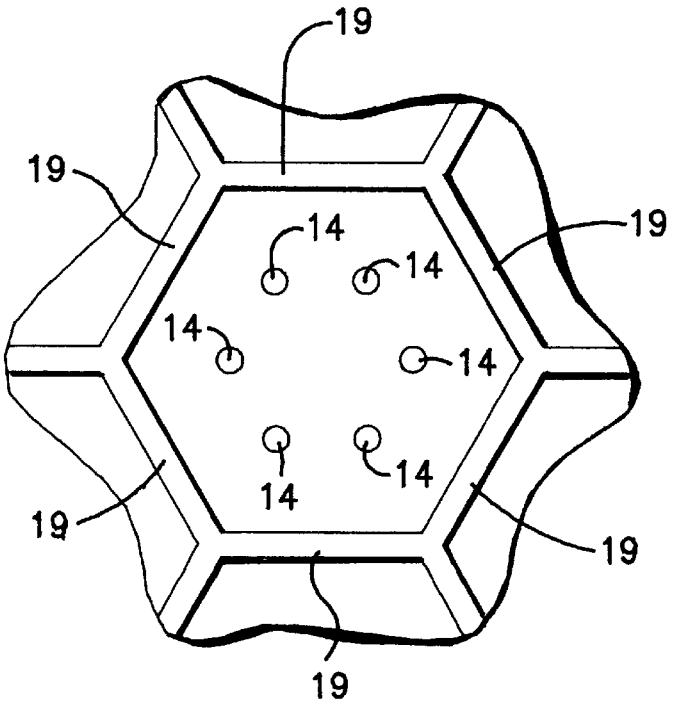
FIG. 3 is a plan view illustrating the arrangement of cathodes in the emissive electron source according to a third embodiment of the present invention.
Figure 4:
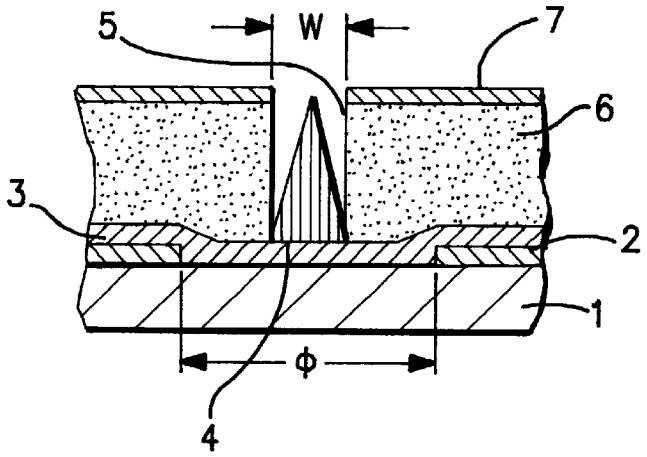
FIG. 4 is a sectional view of essential parts of a conventional emissive electron source.
Figure 5:
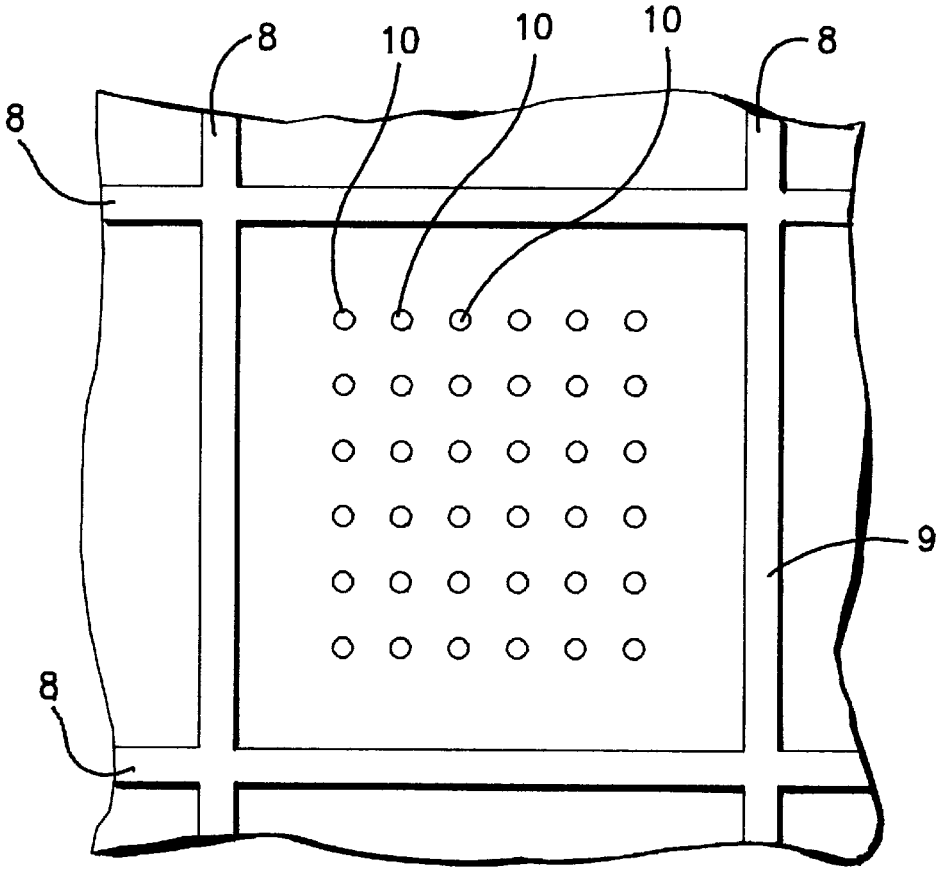
FIG. 5 is a plan view illustrating the arrangement of cathodes in another conventional emissive electron source.

A third embodiment of the present invention is, as shown in FIG. 3, an emissive electron source in which a first electrode 19 consisting of aluminum or the like and having a width of about 1 μm and a thickness of 0.2 μm is deposited on an insulating substrate 1 such as glass with a pitch of 20 μm to form an equilateral hexagonal mesh. A resistive coating 13 consisting of a silicon film or the like which has a thickness of about 0.5 μm and resistance of about 3000 Ω·cm is deposited on the entire surface of the insulating substrate 1 including the first electrode. Six conical cathodes 14 are disposed in a form of equilateral hexagon with a pitch of 4 μm at the center of an area surrounded by the first electrode 19 on the resistive coating 13. The conical cathode 14 consists of metal such as tungsten or molybdenum with high melting point and a low work function and has a sharp tip with a bottom diameter of about 1 μm. Again, although not shown in the figure, the cavity, insulating layer and second electrode are formed in the same manner as in the first embodiment.

This embodiment has the density of cathode higher than that of the first embodiment, and has the same advantages as the first embodiment that it can prevent destruction of the device due to short-circuiting between the second electrode and the cathode, and electrons are evenly emitted from the cathode.

While the present invention has been described for the cases where the first electrode is formed in a regular n-sided polygon mesh pattern, and a plurality of cathodes are disposed at the center of the mesh, it is not limited to such arrangement, but it is needless to say that the shape of mesh may be, for example, rectangular, and a plurality of cathodes may be disposed at the center of the rectangle or the first electrode may be formed in an equilateral triangular mesh, with one cathode disposed at the center of the mesh.

As is described above, in the emissive electron source according to the present invention, because the respective cathodes are disposed at equal distance to the first electrode applying a voltage to the cathode, the resistive coating provides equal resistance to every cathode so that even electron emission characteristics are attained. In addition, because a plurality of cathodes can be disposed in an area surrounded by the first electrode, the resistive coating can have high resistance even if the pitch between the cathodes is made very small so that the capability for limiting the short-circuiting current can be improved even when the cathode density is increased. Furthermore, even electron emission can be maintained by the resistive coating between the cathodes.

What is claimed is:

1. An emissive electron source comprising; a first electrode formed on an insulating substrate in a form of mesh, a resistive coating formed on the entire surface of said first electrode and said substrate; an insulating layer having a plurality of cavities formed on said resistive coating; a second electrode formed on said insulating layer; said plurality of cavities being formed in a mesh divided by said first electrode, and a conical cathode disposed in each of said cavities in contact with the resistive coating, each of said cathodes being disposed to have the equal minimum distance with respect to said first electrode.

2. An emissive electron source as set forth in claim 1, wherein said first electrode is formed in a regular n-sided polygon mesh pattern, and the same number "n" of said cathodes are disposed in respective meshes of said mesh pattern in a regular n-sided pattern.

3. An emissive electron source as set forth in claim 1, wherein said first electrode is formed in a rectangular mesh pattern, and a plurality of said cathodes are disposed in respective meshes of said mesh pattern in a similar figure.

4. An emissive electron source comprising:

an insulating substrate;

a first electrode formed on the insulating substrate and shaped as an intersecting web of linear segments;

a resistive coating covering the first electrode and the substrate;

an insulating layer disposed on the resistive coating, the insulating layer having a plurality of apertures therethrough;

a second electrode disposed on the insulating layer, the second electrode having apertures disposed therethrough in alignment with the apertures of the insulating layer; and a plurality of conical cathodes, one of the plurality of conical cathodes being disposed upon the resistive coating within each of the apertures of the insulating layer;

wherein the plurality of conical cathodes are disposed with respect to the intersecting linear segments of the first electrode such that each of the conical cathodes is equidistant from a respective nearest point of the first electrode.

5. The emissive electron source of claim 4, wherein the first electrode is formed as a repeating pattern of regular polygons, each of the polygons encompassing a plurality of the conical cathodes equal in number to a number of sides of each of the regular polygons.

6. The emissive electron source of claim 5, wherein the conical cathodes within each of the regular polygons are arranged to form vertices of a regular polygon.

7. The emissive electron source of claim 4, wherein the first electrode is formed as a repeating pattern of rectangles, each of the rectangles encompassing a plurality of the conical cathodes.

8. The emissive electron source of claim 7, wherein the plurality of conical cathodes are disposed in a second repeating pattern amongst the repeating pattern of rectangles.

9. The emissive electron source of claim 4, wherein the first electrode is formed as a repeating pattern of equilateral triangles, each of the triangles encompassing one of the plurality of conical cathodes centered therein.

* * * * *